US006968922B2

(12) United States Patent
Kawamata et al.

(10) Patent No.: US 6,968,922 B2
(45) Date of Patent: Nov. 29, 2005

(54) EXHAUST APPARATUS FOR VEHICLE

(75) Inventors: Noriyuki Kawamata, Saitama (JP); Hiroaki Koishi, Saitama (JP); Kou Kurata, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/321,375

(22) Filed: Dec. 18, 2002

(65) Prior Publication Data

US 2003/0136607 A1 Jul. 24, 2003

(30) Foreign Application Priority Data

Dec. 19, 2001 (JP) ..... 2001-385989

(51) Int. Cl.[7] ..... F01N 3/06; F01N 3/02

(52) U.S. Cl. ..... 181/231; 181/241; 181/243; 181/251; 181/268; 181/269; 181/272; 181/255; 55/307; 55/315; 55/319; 55/385.3; 55/391; 55/DIG. 20; 55/DIG. 30

(58) Field of Search ..... 181/227–231, 181/228, 255–258, 282, 241, 243, 251, 268–270, 181/275, 276, 272; 55/331, 412–414, 463, 55/DIG. 20, DIG. 30, 307–309, 315, 318–326, 55/342–350.1, 385.3, 391, 410, 337; 96/386

(56) References Cited

U.S. PATENT DOCUMENTS 2,075,264 A * 3/1937 Maxim et al. ..... 181/231
2,600,262 A * 6/1952 Powers ..... 96/385
3,757,892 A * 9/1973 Raudman, Jr. ..... 181/256
3,847,577 A * 11/1974 Hansen ..... 55/385.3
3,884,655 A * 5/1975 Coop ..... 96/380
3,898,064 A * 8/1975 Tao et al. ..... 96/386
4,119,174 A * 10/1978 Hoffman ..... 181/231
4,218,228 A * 8/1980 Hiraoka et al. ..... 55/319
4,315,559 A * 2/1982 Casey ..... 181/265
4,393,652 A * 7/1983 Munro ..... 60/295
4,574,913 A * 3/1986 Fukuda ..... 181/231

(Continued)

FOREIGN PATENT DOCUMENTS

JP 56038514 A * 4/1981 ..... F01N 3/06

(Continued)

OTHER PUBLICATIONS

Patent Abstract of Japan, Publ. No. 08061045A, Mar. 5, 1996. "Spark Arrester of Exhaust Device for Vehicle," Takanori Okuma et al.

*Primary Examiner*—Marlon T. Fletcher
*Assistant Examiner*—Renata McCloud
(74) *Attorney, Agent, or Firm*—Birch, Stewart, Kolasch & Birch, LLP

(57) ABSTRACT

An exhaust apparatus for a vehicle includes a spark arrester having a tubular spark arrester body assembled on a rear portion of a muffler connected to an exhaust pipe. A tail pipe is inserted in the spark arrester body and is mounted on the spark arrester such that exhaust gas flowing through the muffler is discharged into the atmospheric air from the tail pipe through the spark arrester, to carry out, expansion and contraction of exhaust gas in the spark arrester occurs to augment the sound reduction performance. An annular partition plate cooperates with an inner face of a spark arrester body to form a throttle path therebetween that is securely mounted on a tail pipe wherein a plurality of expansion chambers that communicate with each other through the throttle path are formed between the tail pipe and the spark arrester body with the annular partition plate disposed therebetween.

19 Claims, 6 Drawing Sheets

U.S. PATENT DOCUMENTS 4,673,423 A * 6/1987 Yumlu ..... 55/319
4,924,570 A * 5/1990 Mizrah et al. ..... 29/896.62
5,048,287 A * 9/1991 Howe et al. ..... 60/288
5,135,551 A * 8/1992 Fielding ..... 96/279
5,227,593 A * 7/1993 Takahashi et al. ..... 181/255
5,509,947 A * 4/1996 Burton ..... 96/383
5,627,351 A * 5/1997 Okuma et al. ..... 181/231
5,969,299 A * 10/1999 Yamaguchi et al. ..... 181/227
6,467,570 B1 * 10/2002 Herold ..... 181/231
6,673,136 B2 * 1/2004 Gillingham et al. ..... 95/273

FOREIGN PATENT DOCUMENTS

JP 10-266828 A 6/1998
JP 2001164920 A * 6/2001 ..... F01N 1/08
JP 2001263045 A * 9/2001 ..... F01N 3/06

* cited by examiner

EXHAUST APPARATUS FOR VEHICLE

CROSS-REFERENCE TO RELATED APPLICATIONS

The present nonprovisional application claims priority under 35 USC 119 to Japanese Patent Application Number 2001-385989 filed on Dec. 19, 2001 the entire contents thereof is hereby incorporated by reference.

BACKGROUND OF THE INVENTION

1. Field to Which the Invention Pertains

This invention relates to an exhaust apparatus for a vehicle wherein a spark arrester having a tubular spark arrester body is assembled to a rear portion in a muffler connected to an exhaust pipe and a tail pipe inserted in the spark arrester body is mounted on the spark arrester such that exhaust gas flowing through the muffler is discharged into the atmospheric air from the tail pipe through the spark arrester.

2. Description of Background Art

Conventionally, an apparatus as described above is disclosed, for example, in the official gazette of Japanese Patent Laid-Open Number Hei 8-61046, the official gazette of Japanese Patent Laid-Open Number Hei 10-266828, and so forth.

Incidentally, in order to improve the sound reduction performance, a countermeasure of repeating expansion and contraction of exhaust gas in a muffler is conventionally taken, and it is estimated that, if such an expansion and contraction are repeated also in a spark arrester, then the sound reduction performance can be further augmented.

However, in the conventional countermeasure described above, a simple cylindrical tail pipe which is open at the opposite ends thereof is inserted in a spark arrester body which has a similar cylindrical shape. Therefore, exhaust gas introduced into the spark arrester after circulated in the muffler flows into the tail pipe from its front end and is discharged into the atmospheric air from a rear end of the tail pipe, and expansion and contraction of exhaust gas are not carried out in the spark arrester.

Therefore, it is desired to partition the inside of the spark arrester into a plurality of portions. In this instance, however, if a partition plate is provided in the spark arrester, then the structure of the spark arrester is complicated, which is not desirable.

SUMMARY AND OBJECTS OF THE INVENTION

The present invention has been made in view of such a circumstance as described above. It is an object of the present invention to provide an exhaust apparatus for a vehicle wherein, while a spark arrester body is kept in a simple structure, expansion and contraction of exhaust gas are carried out in the spark arrester to augment the sound reduction performance.

In order to attain the object described above, according to the present invention, an exhaust apparatus for a vehicle is provided wherein a spark arrester having a tubular spark arrester body is assembled to a rear portion in a muffler connected to an exhaust pipe and a tail pipe inserted in the spark arrester body is mounted on the spark arrester such that exhaust gas flowing through the muffler is discharged into the atmospheric air from the tail pipe through the spark arrester. An annular partition plate is provided which cooperates with an inner face of the spark arrester body to form a throttle path therebetween that is securely mounted on the tail pipe such that a plurality of expansion chambers which communicate with each other through the throttle path are formed between the tail pipe and the spark arrester body with the annular partition plate disposed therebetween.

With such a configuration as described above, only if the tail pipe on which the annular partition plate is securely mounted is inserted into the spark arrester body, a plurality of expansion rooms and a throttle path which communicates the expansion rooms with each other are formed between the tail pipe and the spark arrester body. Thus, when exhaust gas circulates between adjacent expansion rooms through the throttle path, expansion and contraction of exhaust gas is carried out also in the spark arrester. Consequently, the sound reduction performance can be augmented. In addition, the spark arrester body can be kept in a simple structure only by securely mounting the annular partition plate on the tail pipe.

According to the present invention, the exhaust apparatus for a vehicle includes a tail pipe that is removably mounted on the spark arrester. According to such a configuration as just described, alteration of the muffler characteristic by replacement of the tail pipe is facilitated.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

In the following, an embodiment of the present invention is described based on embodiments of the present invention shown in the accompanying drawings.

Figure 1:
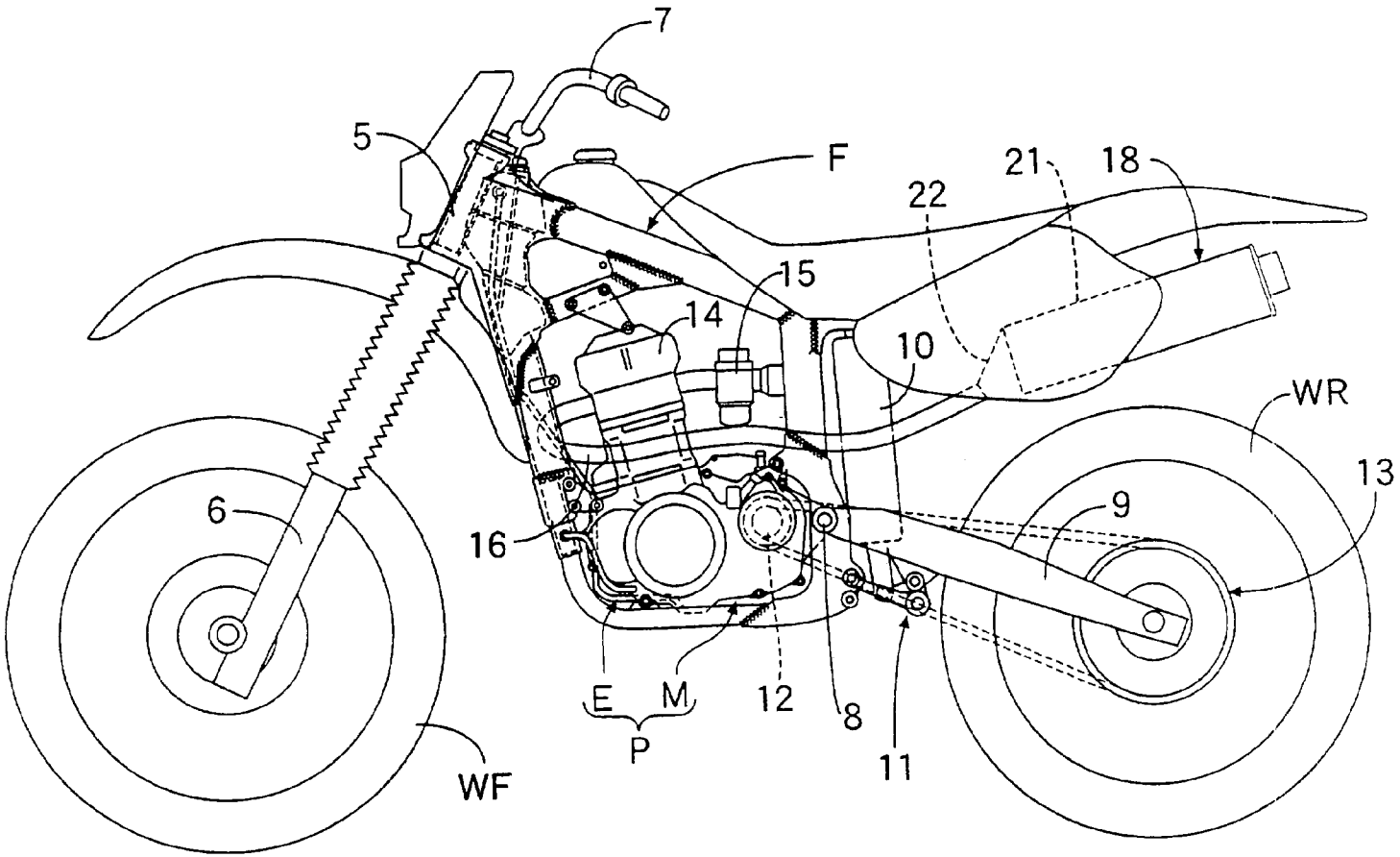
FIG. 1 is a side elevational view of a motorcycle of a first embodiment.

FIGS. 1 to 5 show a first embodiment of the present invention. Referring first to FIG. 1, a front fork 6 for supporting a front wheel WF for rotation thereon is supported for steering operation on a head pipe 5 provided at a front end of a body frame F of the motorcycle, and a steering handle bar 7 is connected to the front fork 6. Meanwhile, a rear fork 9 is supported at a front portion thereof for upward and downward rocking motion on the body frame F through a support shaft 8, and a rear wheel WR is supported for rotation at a rear portion of the rear fork 9.

A rear cushion unit 10 is connected at an upper portion thereof to an upper portion of the body frame F, and the rear cushion unit 10 is connected at a lower portion thereof to an intermediate portion of the rear fork 9 through a link mechanism 11.

A power unit P including an engine E and a transmission M is carried on the body frame F, and power outputted from the power unit P, that is, power outputted from an output power shaft 12 of the transmission M, is transmitted to the rear wheel WR through chain type power transmission means 13.

A carburetor 15 is connected to a side face of a rear portion of a cylinder head 14 provided on the engine E, and an exhaust pipe 16 is connected at an upstream end thereof to a side face of a front portion of the cylinder head 14. The exhaust pipe 16 extends forwardly from the cylinder head 14 to the rear side past one side of the engine E and is connected to a muffler 18 disposed above the rear wheel WR and depending from and supported on the body frame F.

Figure 2:
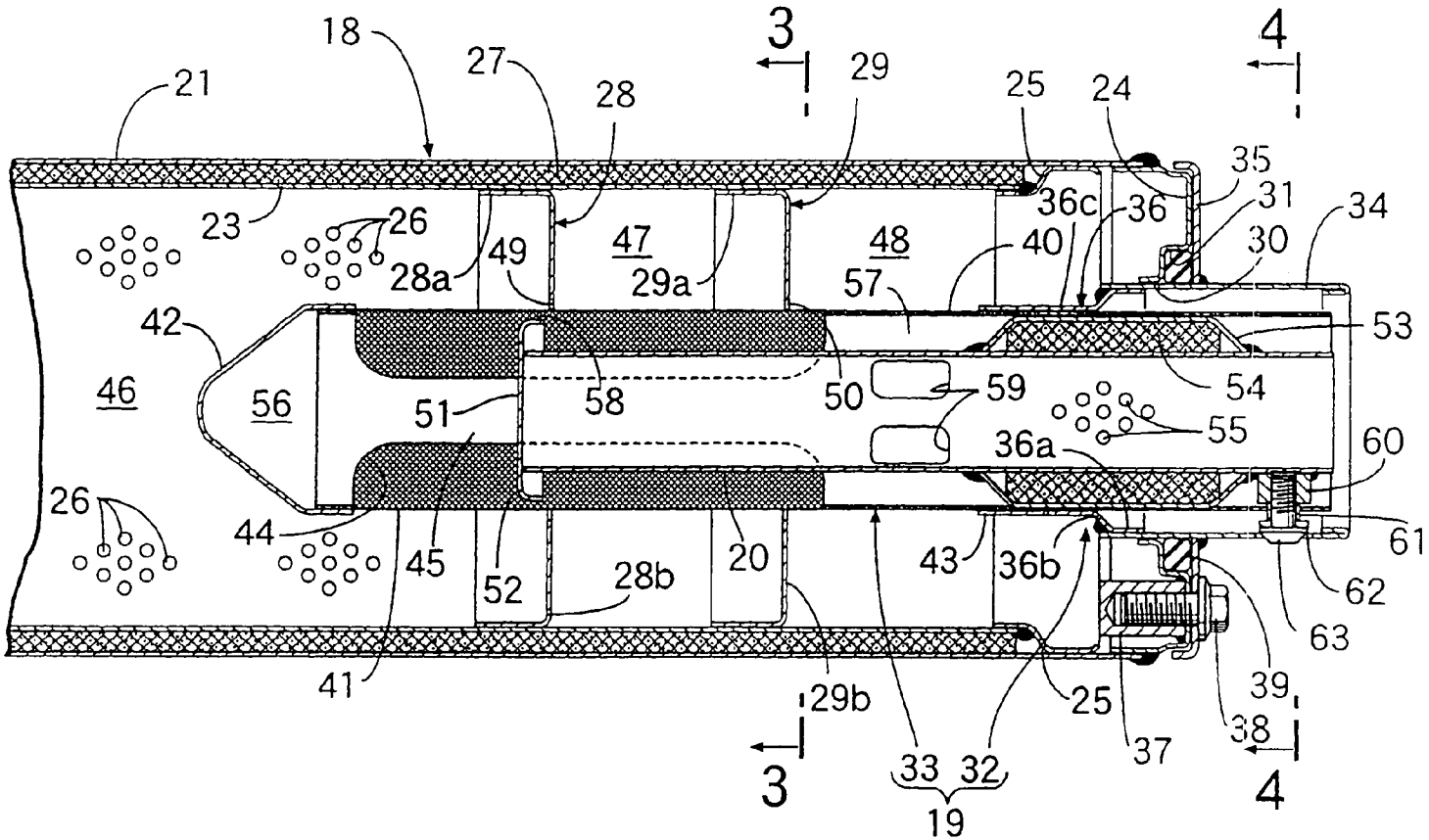
FIG. 2 is a vertical sectional view of an essential part of an exhaust apparatus.
Figure 3:
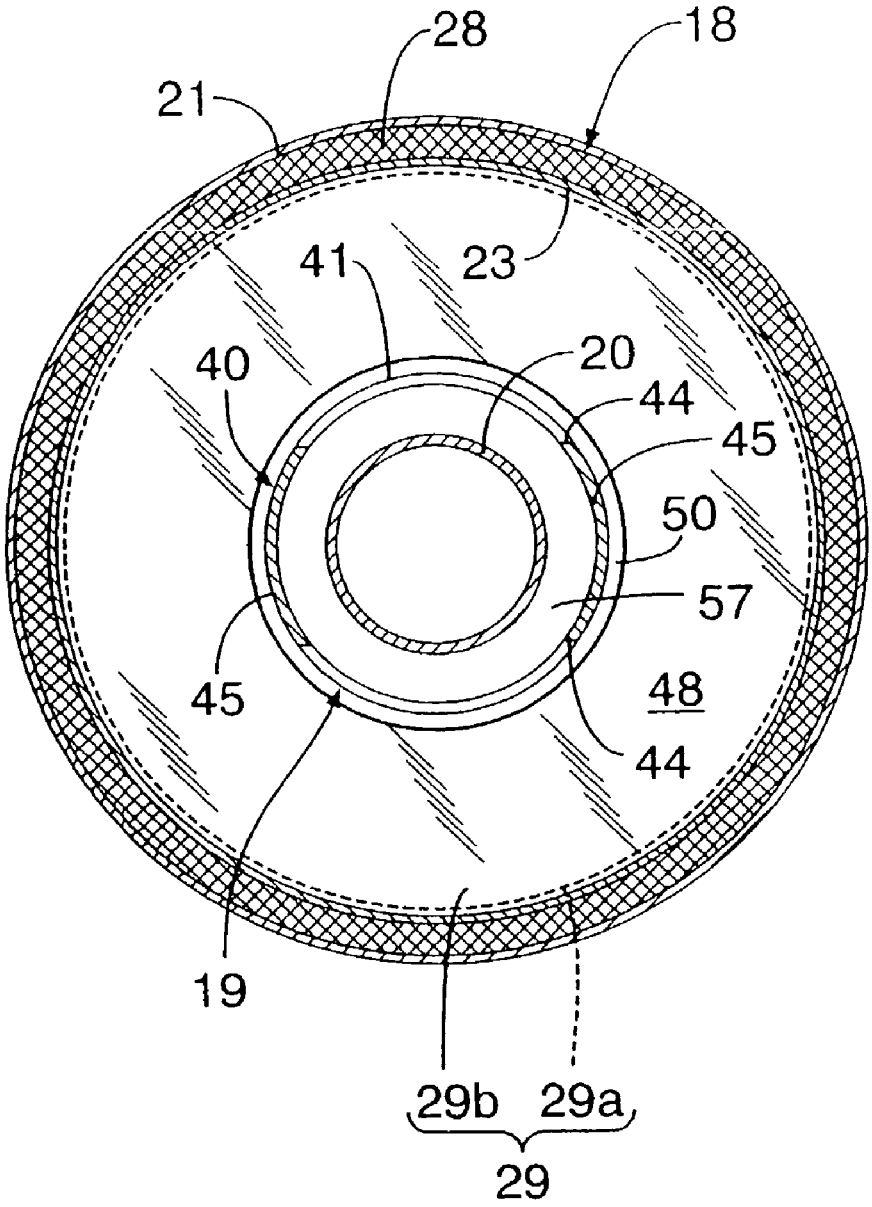
FIG. 3 is a sectional view taken along line 3—3 of FIG. 2.
Figure 4:
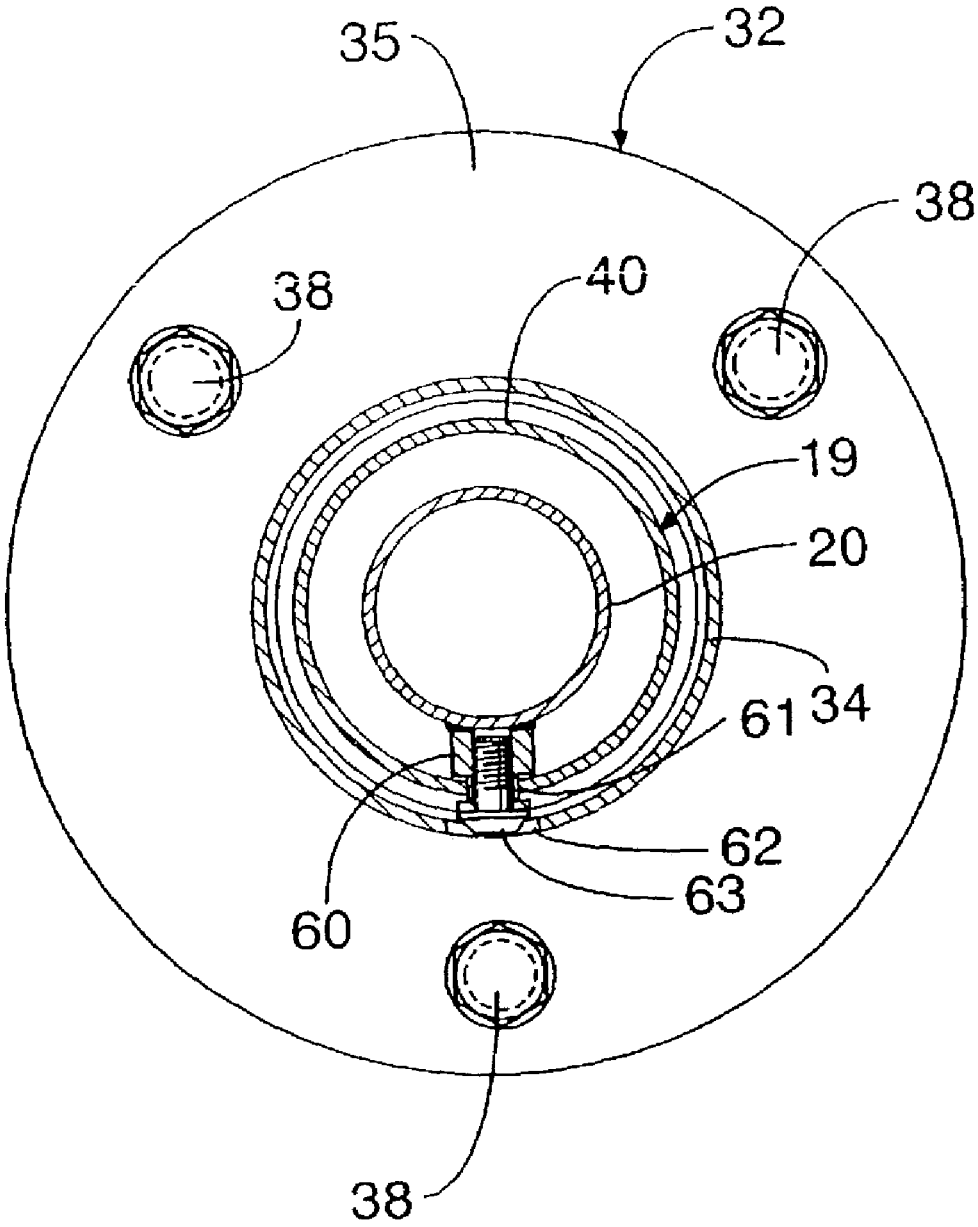
FIG. 4 is a sectional view taken along line 4—4 of FIG. 2.

Referring also to FIGS. 2 to 4, a spark arrester 19 is assembled to a rear portion in the muffler 18 to which the exhaust pipe 16 is connected, and a tail pipe 20 is removably mounted on the spark arrester 19 such that exhaust gas introduced into the muffler 18 from the exhaust pipe 16 is discharged into the atmospheric air from the tail pipe 20 through the spark arrester 19.

The muffler 18 includes a hollow and cylindrical outer tube 21 open at the opposite ends thereof, an exhaust pipe connecting tube 22 (refer to FIG. 1) of a circular truncated conical shape extending forwardly and downwardly from the front end of the outer tube 21 with an inner tube 23 formed in a hollow cylindrical shape and is disposed fixedly in and coaxially with the outer tube 21. An annular end plate 24 is welded to a rear end portion of the outer tube 21 in such a manner so as to close up the rear end of the outer tube 21.

A downstream end of the exhaust pipe 16 is inserted airtight in the exhaust pipe connecting tube 22 and fixedly connected to the muffler 18.

Support rings 25, . . . (two of which are shown in FIG. 2) are welded to an inner face of the opposite end portions of the outer tube 21 with the inner tube 23 having a large number of punched holes 26, 26, . . . welded at the opposite end portions thereof to the support rings 25, . . . A sound-absorbing material 27 made of glass wool or the like is filled in an annular air gap formed between the outer tube 21 and the inner tube 23 so that exhaust noise when exhaust gas flows in the inner tube 23 is absorbed and reduced by the sound-absorbing material 27.

First and second separators 28, 29 are disposed at two locations spaced from each other in the forward and backward directions of an inner face of the inner tube 23 rather near to the rear end. The first and second separators 28, 29 integrally have tubular portions 28*a*, 29*a*, and annular plate portions 28*b*, 29*b* extending inwardly in a radial direction from the rear ends of the tubular portions 28*a*, 29*a*, and the tubular portions 28*a*, 29*a* are welded at outer peripheries thereof to the inner periphery of the inner tube 23. Further, the end plate 24 has an insertion opening 30 formed at a central portion thereof and an annular concave portion 31 surrounding the insertion opening 30.

The spark arrester 19 includes a holder 32 removably mounted on the muffler 18, and a spark arrester body 33 welded to the holder 32.

The holder 32 includes a first support tube 34 formed as a hollow cylinder which is open at the opposite ends thereof and inserted in the insertion opening 30 of the end plate 24, a flange 35 welded at an inner peripheral portion thereof to an outer face of an intermediate portion of the first support tube 34 and extending outwardly in a radial direction from the first support tube 34, and a second support tube 36 welded to a front end portion of the first support tube 34 such that it extends forwardly from the front end of the first support tube 34.

The second support tube 36 has a large diameter tubular portion 36*a* fitted in a front end portion of the first support tube 34, a tapered tubular portion 36*b* having a diameter decreasing forwardly and joined integrally at a large diameter end thereof to the front end of the large diameter tubular portion 36*a*, and a small diameter portion 36*c* joined integrally to a small diameter end, that is, the front end, of the tapered tubular portion 36*b*. The joining portion between the large diameter tubular portion 36*a* and the tapered tubular portion 36*b* is welded to the front end of the first support tube 34.

Meanwhile, a plurality of, for example, three, nuts 37, . . . (one of which is shown in FIG. 2) are welded in an equally spaced relationship from each other in a circumferential direction on the inner face of the end plate 24, and a plurality of bolts 38, . . . inserted in the flange 35 contacting with the outer face of the end plate 24 and the end plate 24 are screwed in the nuts 37. Thus, the holder 32 is removably mounted on the muffler 18 by tightening the bolts 38 In addition, an annular seal member 39 closely contacts with an outer periphery of the first support tube 34 and is mounted in the concave portion 31 in such a manner that it is sandwiched by the end plate 24 and the flange 35.

The spark arrester body 33 includes a tubular member 40 of a hollow tubular shape fitted in the second support tube 36 of the holder 32 and extends forwardly and backwardly. A filter 41 of a hollow tubular shape is mounted on an outer periphery of the tubular member 40 at a location projecting forwardly from the second support tube 36. A cap 42 is welded to the outer periphery of the front end of the tubular member 40 in such a manner that it cooperates with the outer periphery at the front end of the tubular member 40 to hold a front end portion of the filter 41 therebetween for closing up the opening at the front end of the tubular member 40. A holding ring 43 of a short cylindrical shape is welded to the outer periphery of the tubular member 40 forwardly of the second support tube 36 in such a manner that it cooperates with the outer periphery of the tubular member 40 to hold a rear end portion of the filter 41 therebetween.

The tubular member 40 is welded to the small diameter portion 36*c* of the second support tube 36, and a pair of openings 44, 44 extending along in an axial direction and a pair of support bones 45, . . . disposed between the openings 44, 44 are formed on the tubular member 40 at a front half portion between the cap 42 and the holding ring 43 such that the support bones 45, . . . are disposed on a diametrical line of the tubular member 40. Meanwhile, the filter 41 is formed in a mesh from wire cloth or the like and mounted on the tubular member 40 in such a manner that it covers the openings 44, 44 from the outside.

The spark arrester 19 is assembled to a rear portion in the muffler 18, and in the inner tube 23 of the muffler 18, a first expansion chamber 46 is disposed forwardly of the first separator 28 with the front end of the spark arrester body 33 accepted therein. A second expansion chamber 47 is disposed between the first and second separators 28, 29 in such a manner so as to surround the spark arrester body 33. A third expansion chamber 48 is disposed rearwardly of the second separator 29 in such a manner so as to surround the spark arrester body 33. The openings 44, 44 are formed in the tubular member 40 such that they communicate with the first to third expansion chambers 46, 47, 48 through the filter 41.

Further, the radius of the inner circumferences of the annular plate portions 28*b*, 29*b* of the first and second separators 28, 29 are set a little greater than the radius of the outer circumference of the spark arrester body 33. An annular first throttle path 49 interconnects the first and second expansion chambers 46, 47 and is formed between the first separator 28 and the spark arrester body 33 while an annular second throttle path 50 that interconnects the second and third expansion chambers 47, 48 is formed between the second separator 29 and the spark arrester body 33.

Figure 5:
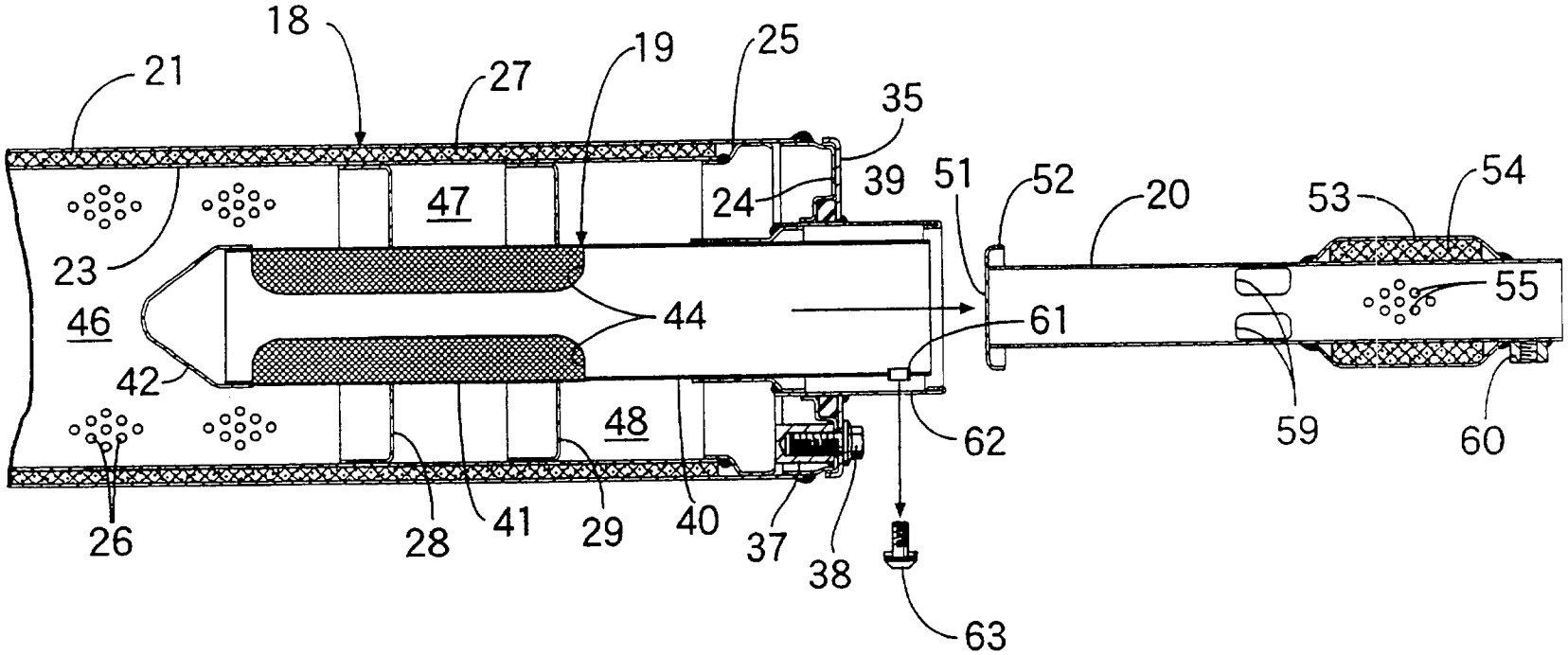
FIG. 5 is a sectional view corresponding to FIG. 2 but in a state wherein a tail pipe is removed.

Referring also to FIG. 5, the tail pipe 20 is inserted coaxially into the tubular member 40 of the spark arrester 19 from the rear end. A lid plate 51 closes up the opening at the front end of the tail pipe 20 and is securely mounted at the front end of the tail pipe 20. An annular partition plate 52 extends outwardly in a radial direction from the outer periphery of the tail pipe 20 and is provided integrally on an outer periphery of the lid plate 51.

A sound absorbing tube 53 having opposite ends that are formed in a tapering manner is welded to the outer periphery of the tail pipe 20 at a position rather near to the rear portion such that it surrounds the tail pipe 20. Sound absorbing material 54 of glass wool or the like is filled in an air gap between the sound absorbing tube 53 and the tail pipe 20. A large number of small holes 55, 55, . . . are performed in the tail pipe 20 at a position corresponding to the sound absorbing material 54.

By insertion of the tail pipe 20 in the tubular member 40, a fourth expansion chamber 56 in which the front end of the tail pipe 20 is accepted and an annular fifth expansion chamber 57 which surrounds the tail pipe 20 are formed in the tubular member 40 across the annular partition plate 52. An annular third throttle path 58 interconnects the fourth and fifth expansion chambers 56, 57 and is formed between the outer periphery of the annular partition plate 52 and the inner periphery of the spark arrester body 33.

In addition, the fourth and fifth expansion chambers 56, 57 are in communication with the first to third expansion chambers 46 to 48 through the openings 44, 44 and the filter 41. A plurality of communicating holes 59, . . . are provided for communicating the fifth expansion chamber 57 with the inside of the tail pipe 20 are provided in the tail pipe 20 at a location rather near to the sound absorbing tube 53 between the annular partition plate 52 and the sound absorbing tube 53.

Further, a nut 60 is securely mounted, for example, at one location of the outer periphery of the tail pipe 20 on the rear side of the sound absorbing tube 53. An insertion tube 61 extends through a side wall of the tubular member 40 and is securely mounted at a rear portion of the tubular member 40 of the spark arrester 19 in a corresponding relationship with the nut 60. An insertion hole 62 corresponding to the insertion tube 61 is provided with a diameter greater than that of the guide tube 61 in the first support tube 34 of the spark arrester 19.

Thus, by screwing, in a state wherein the tail pipe 20 is inserted in the spark arrester 19, a bolt 63 may be inserted in the insertion tube 61 through the insertion hole 62 into the nut 60 and tightening the bolt 63, the tail pipe 20 is secured to the spark arrester 19. In addition, by loosening the bolt 63 and removing the bolt 63 from the nut 60, the tail pipe 20 can be removed from the spark arrester 19 as shown in FIG. 5.

Now, the operation of the first embodiment is described. Upon operation of the engine E, exhaust gas exhausted from the engine E flows from the exhaust pipe 16 into the muffler 18 and enters the second expansion chamber 47 from the first expansion chamber 46 in the muffler 18 through the first throttle path 49. Thereafter, the exhaust gas flows into the third expansion chamber 48 from the second expansion chamber 47 through the second throttle path 50. In other words, the exhaust gas from the engine E undergoes repetitions of expansion and contraction in the muffler 18, and consequently, exhaust noise can be reduced effectively.

The expansion chambers 46, 47, 48 are communicated with the inside of the spark arrester body 33 of the spark arrester 19 through the filter 41 and the openings 44, 44. When exhaust gas flows into the spark arrester body 33 through the filter 41, unburned components such as soot included in the exhaust gas are caught by the filter 41.

Further, the fourth and fifth expansion chambers 56, 57 are also formed between the spark arrester body 33 and the tail pipe 20 inserted in the spark arrester body 33. Exhaust gas flowing into the fourth expansion chamber 56 from the first expansion chamber 46 through the filter 41 and the openings 44, 44 flows into the fifth expansion chamber 57 through the third throttle path 58 and is then discharged into the atmospheric air from the fifth expansion chamber 57 through the communicating holes 59, . . . and the tail pipe 20. Consequently, also in the spark arrester body 33, expansion and contraction of the exhaust gas are repeated, and therefore, the sound reduction performance can be further augmented.

In addition, in order to form the fourth and fifth expansion chambers 56, 57 and the third throttle path 58 which interconnects the fourth and fifth expansion chambers 56, 57 in the spark arrester body 33, it is only necessary to insert the tail pipe 20 to which the annular partition plate 52 is securely mounted into the spark arrester body 33. Thus, the spark arrester body 33 can be maintained in a simple structure.

Furthermore, the tail pipe 20 is removably mounted on the spark arrester 19, and an alteration of the muffler characteristic by replacement of the tail pipe 20 is facilitated.

Figure 6:
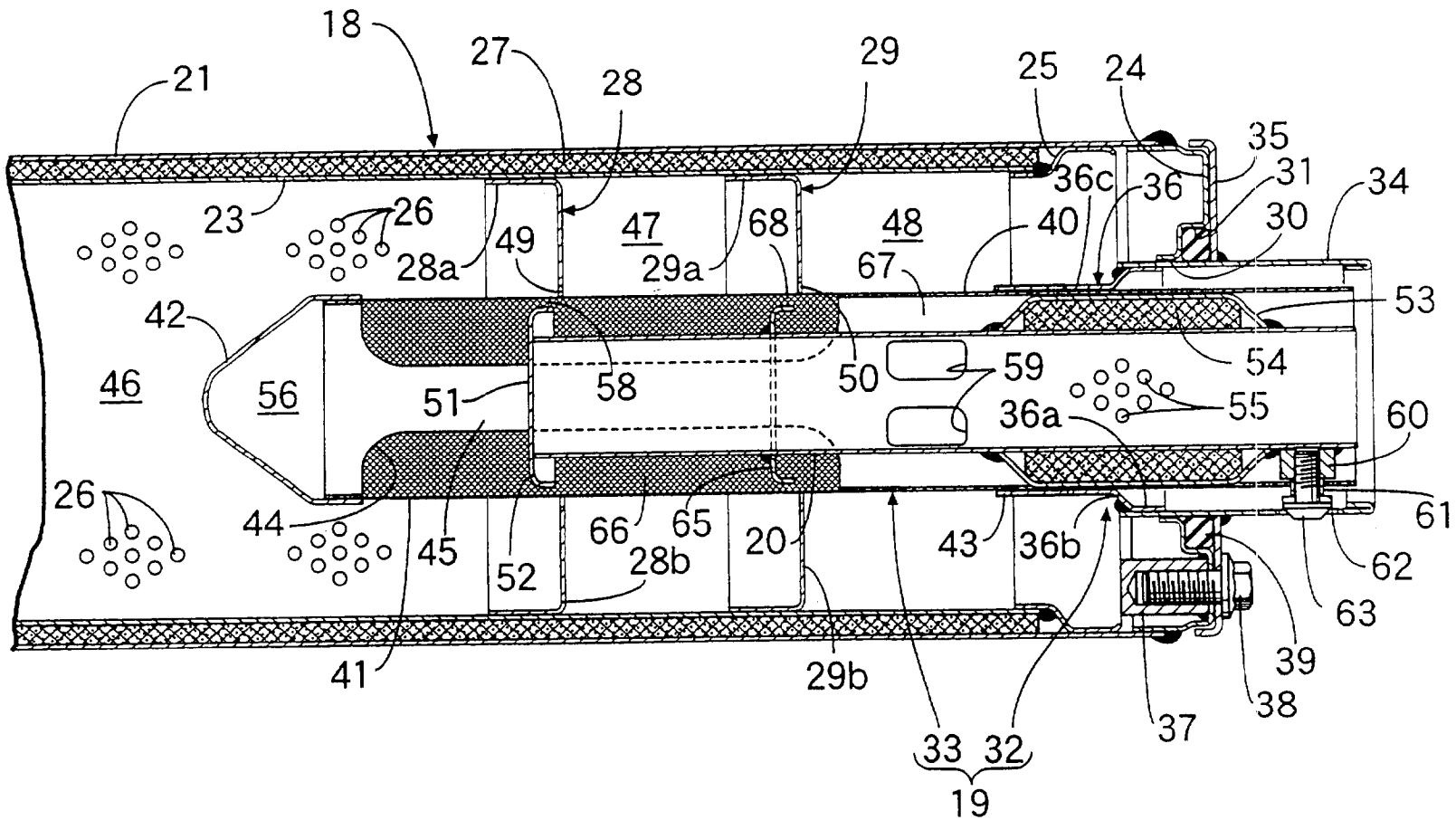
FIG. 6 is a vertical sectional view of an essential part of an exhaust apparatus of a second embodiment.

FIG. 6 shows a second embodiment of the present invention, and elements corresponding to those of the first embodiment described above are denoted by like reference characters.

A lid plate 51 having an annular partition plate 52 integrally on an outer periphery thereof is securely mounted on a tail pipe 20 removably mounted on a spark arrester 19 in such a manner so as to close up an opening at the front end of the tail pipe 20. An annular partition plate 65 extends outwardly in a radial direction from an outer periphery of an intermediate portion of the tail pipe 20 and is securely mounted on the tail pipe 20.

If the tail pipe 20 is inserted into a tubular member 40 of the spark arrester 19, then a fourth expansion chamber 56 in which the front end of the tail pipe 20 is accepted, an annular sixth expansion chamber 66 surrounding the tail pipe 20 at a position wherein it cooperates with the fourth expansion chamber 56 to hold the annular partition plate 52 therebetween and communicates with the fourth expansion chamber 56 through a third throttle path 58, and a seventh expansion chamber 67 cooperating with the sixth expansion chamber 66 to hold the annular partition plate 65 therebetween are formed in the tubular member 40. An annular fourth throttle path 68 interconnecting the sixth and seventh expansion chambers 66, 67 is formed between the outer periphery of the partition plate 65 and the inner periphery of the spark arrester body 33.

Further, the sixth and seventh expansion chambers 66, 67 are in communication with the first to third expansion chambers 46 to 48 through the openings 44, 44 and the filter 41. The seventh expansion chamber 67 is in communicated with the inside of the tail pipe 20 through a plurality of communicating holes 59, . . . provided in the tail pipe 20.

According to the second embodiment, expansion and contraction of exhaust gas is repeated a greater number of times in the spark arrester body 33, and the sound reduction performance can be further augmented. In addition, in order to form the fourth, sixth and seventh expansion chambers 56, 66, 67 and the third and fourth throttle paths 58, 68 interconnecting the expansion chambers 56, 66, 67 in the spark arrester body 33, it is only necessary to insert the tail pipe 20 having the annular partition plates 52, 65 securely mounted thereon into the spark arrester body 33. Thus, the spark arrester body 33 can be maintained in a simple structure.

While embodiments of the present invention are described above, the present invention is not limited to the embodiments described above but allows various design modifications without departing from the present invention.

As described above, only when the tail pipe on which the annular partition plate is securely mounted is inserted into the spark arrester body does the expansion and contraction of exhaust gas occur in the spark arrester. Consequently, the sound reduction performance can be augmented. In addition, the spark arrester body can be maintained in a simple structure.

According to the effect of the invention, an alteration of the muffler characteristic by replacement of the tail pipe is facilitated.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An exhaust apparatus for a vehicle wherein a spark arrester includes a tubular spark arrester body with a front end and a rear end, said rear end of said spark arrester being mounted adjacent to a rear portion in a muffler connected to an exhaust pipe and a tail pipe inserted in said spark arrester body, said tail pipe being mounted on said spark arrester wherein exhaust gas flowing through said muffler is discharged into the atmospheric air from said tail pipe through said spark arrester comprising:

a first separator being disposed between the muffler and the spark arrester body with the front end of the spark arrester body, the spark arrester body extending beyond the first separator for forming a first expansion chamber;

said first separator including an annular plate portion positioned adjacent to an inner face of said spark arrester body for forming a throttle path therebetween, said annular plate portion being securely mounted on said muffler;

a plurality of expansion chambers for communicating with each other through said throttle path, said plurality of expansion chambers being formed between said tail pipe and said spark arrester body with said annular plate portion disposed; and a cap attached to the front end of said spark arrester body for closing an opening at the front end of said spark arrester body, said cap extending beyond the first separator, said spark arrester body having an opening extending in an outer peripheral surface thereof for providing communication between at least a first expansion chamber and a second expansion chamber, and said tail pipe extending within said spark arrester body with front end of said tail pipe extending beyond said first separator.

2. The exhaust apparatus for a vehicle according to claim 1, wherein the tail pipe is removably mounted on said spark arrester.

3. The exhaust apparatus for a vehicle according to claim 1, wherein said spark arrester body extends a predetermined distance within said muffler and the cap disposed on the front end of said spark arrester body is disposed within said muffler.

4. The exhaust apparatus for a vehicle according to claim 1, and further including a second separator disposed between said muffler and said spark arrester body for forming a second expansion chamber disposed between said first separator and said second separator, said rear end of the spark arrester body extending beyond the second separator for forming the second expansion chamber.

5. The exhaust apparatus for a vehicle according to claim 4, and further including an annular end plate disposed between said muffler and said spark arrester body for forming a third expansion chamber disposed between said second separator and said rear portion of said muffler.

6. The exhaust apparatus for a vehicle according to claim 1, wherein a first throttle path is disposed between said first separator and an exterior surface of said spark arrester.

7. The exhaust apparatus for a vehicle according to claim 1, wherein a second throttle path is disposed between said second separator and an exterior surface of said spark arrester.

8. The exhaust apparatus for a vehicle according to claim 1, wherein said annular plate portion forming the throttle path with the inner face of said spark arrester body is a third throttle path.

9. The exhaust apparatus for a vehicle according to claim 1, and further including at least one opening disposed within said tail pipe and being in communication with said expansion chambers for discharging exhaust gas from said tail pipe.

10. An exhaust apparatus for a vehicle comprising:

a spark arrester having a spark arrester body with a rear end and a front end, said rear end of said spark arrester body being assembled adjacent to a rear end of a muffler connected to an exhaust pipe;

a tail pipe inserted in said spark arrester body, a rear end of said tail pipe being removably mounted on said rear end of said spark arrester body wherein exhaust gas flowing through said muffler is discharged into the atmospheric air from said tail pipe through said spark arrester;

a first separator being mounted on said muffler to extend inwardly in a radial direction from an inner periphery of said muffler for forming a first expansion chamber and a second expansion chamber between said muffler and said spark arrester body;

said first separator cooperating with an outer face of said spark arrester body to form a throttle path therebetween;

said throttle path enabling said first chamber and said second chamber to communicate with each other;

a cap attached to said front end of said spark arrester body for closing an opening at said front end of said spark arrester body, the front end of said spark arrester body extending beyond the first separator, said cap and a front inner face of said spark arrester body defining a third expansion chamber inside said spark arrester body;

said spark arrester body having an opening extending in an outer peripheral surface thereof for providing communication between at least said first expansion chamber and said third expansion chamber and said tail pipe extending within said spark arrester body with a front end of said tail pipe extending beyond said first separator.

11. The exhaust apparatus for a vehicle according to claim 10, wherein the tail pipe is removably mounted on said spark arrester.

12. The exhaust apparatus for a vehicle according to claim 10, wherein said spark arrester body extends a predetermined distance within said muffler and the cap disposed on the front end of said spark arrester body is disposed within said muffler.

13. The exhaust apparatus for a vehicle according to claim 10, and further including a second separator disposed between said muffler and said spark arrester body for forming said second expansion chamber disposed between said first separator and said second separator, said rear end of the spark arrester body extending beyond the second separator for forming the second expansion chamber.

14. The exhaust apparatus for a vehicle according to claim 13, and further including an annular end plate disposed between said muffler and said spark arrester body for forming said third expansion chamber disposed between said second separator and said rear end of said muffler.

15. The exhaust apparatus for a vehicle according to claim 10, wherein a first throttle path is disposed between said first separator and an exterior surface of said spark arrester.

16. The exhaust apparatus for a vehicle according to claim 10, wherein a second throttle path is disposed between said second separator and an exterior surface of said spark arrester.

17. The exhaust apparatus for a vehicle according to claim 10, wherein said annular plate portion forming the throttle path with the inner face of said spark arrester body is a third throttle path.

18. The exhaust apparatus for a vehicle according to claim 10, and further including at least one opening disposed within said tail pipe and being in communication with said expansion chambers for discharging exhaust gas from said tail pipe.

19. An exhaust apparatus for a vehicle wherein a spark arrester having a tubular spark arrester body is assembled to a rear portion in a muffler connected to an exhaust pipe and a rear portion of a tail pipe which is cylindrical and inserted in said spark arrester body is removably mounted on a rear portion of said spark arrester body such that exhaust gas flowing through said muffler is discharged into the atmospheric air from said tail pipe through said spark arrester, the exhaust apparatus comprising:

a lid plate which closes a front end of said tail pipe being securely mounted at the front end of said tail pipe; and an annular partition plate which extends outwardly in a radial direction from an outer periphery of said tail pipe being provided integrally on an outer periphery of said lid plate, wherein an outer periphery of said annular partition plate cooperates with an inner face of said spark arrester body to form a throttle path therebetween, wherein said annular partition plate cooperates with an inner face of said spark arrester body to form a first expansion chamber between a front end of said spark arrester and said annular partition plate, wherein said first expansion chamber and said second expansion chamber communicate with each other through said throttle path.

* * * * *